US008720718B2

(12) United States Patent
Myers et al.

(10) Patent No.: US 8,720,718 B2
(45) Date of Patent: May 13, 2014

(54) FOLDABLE CARRYING CASE

(76) Inventors: Nancy O. Myers, Eugene, OR (US); Michael O. Myers, Eugene, OR (US); Peter C. King, Eugene, OR (US); Lisa A. King, Eugene, OR (US)

( * ) Notice: Subject to any disclaimer, the term of this patent is extended or adjusted under 35 U.S.C. 154(b) by 676 days.

(21) Appl. No.: 12/599,949

(22) PCT Filed: May 13, 2008

(86) PCT No.: PCT/US2008/063551
§ 371 (c)(1),
(2), (4) Date: Nov. 12, 2009

(87) PCT Pub. No.: WO2008/141319
PCT Pub. Date: Nov. 20, 2008

(65) Prior Publication Data

US 2010/0236953 A1 Sep. 23, 2010

Related U.S. Application Data

(60) Provisional application No. 60/930,298, filed on May 14, 2007.

(51) Int. Cl.
*B65D 6/20* (2006.01)

(52) U.S. Cl.
USPC ..... 220/6; 206/577; 220/7; 220/4.28

(58) Field of Classification Search
USPC ..... 206/223, 577, 546; 220/6, 7, 4.28, 4.33
See application file for complete search history.

(56) References Cited

U.S. PATENT DOCUMENTS

| | | | | |
|---|---|---|---|---|
| 692,564 | A * | 2/1902 | Webb | 229/117.12 |
| 1,451,468 | A * | 4/1923 | Olshan | 220/6 |
| 1,537,760 | A | 5/1925 | Gassett | |
| 2,123,031 | A * | 7/1938 | Weiner | 220/592.16 |
| 2,239,611 | A | 4/1941 | Larin et al. | |
| 2,295,508 | A * | 9/1942 | Altheimer | 229/151 |
| 2,760,669 | A | 8/1956 | Kreutzer | |
| 2,792,144 | A | 5/1957 | Mayer | |
| 2,844,272 | A | 7/1958 | Mayer et al. | |
| 3,031,121 | A * | 4/1962 | Chase | 383/13 |

(Continued)

FOREIGN PATENT DOCUMENTS

WO 2008141319 11/2008

OTHER PUBLICATIONS

HeritageMint.com webpage showing Lock & Lock Storage Bin visited Dec. 10, 2009, Copyright 2009, 1 pg.

(Continued)

*Primary Examiner* — Anthony Stashick
*Assistant Examiner* — Christopher McKinley
(74) *Attorney, Agent, or Firm* — Ganz Law, P.C.

(57) ABSTRACT

A foldable carrying case is described that has an integrated one-piece body of hingeably connected panels, and flexible gussets hingeably connected to the panels. The body is further provided with releasable fasteners. The body converts from a plane configuration to a container configuration, and vice versa. The container configuration is formed by folding the panels and the gussets, and the panels and gussets are connected by the releasable fasteners to prevent the container from unfolding. Also described is a method for making and using such a foldable carrying case. Also described is a kit including such a foldable carrying case and at least one storage container.

20 Claims, 18 Drawing Sheets

(56) References Cited

U.S. PATENT DOCUMENTS

| | | | | | |
|---|---|---|---|---|---|
| 3,262,283 | A | * | 7/1966 | Taylor | 62/372 |
| 3,372,690 | A | * | 3/1968 | Ruiz | 126/261 |
| 4,091,852 | A | * | 5/1978 | Jordan et al. | 383/3 |
| 4,509,645 | A | * | 4/1985 | Hotta | 206/545 |
| 4,892,226 | A | * | 1/1990 | Abtahi | 62/371 |
| 4,984,906 | A | * | 1/1991 | Little | 383/4 |
| 5,046,860 | A | * | 9/1991 | Brennan | 383/38 |
| 5,123,540 | A | * | 6/1992 | Karavias | 206/546 |
| 5,490,396 | A | * | 2/1996 | Morris | 62/457.2 |
| D373,515 | S | * | 9/1996 | Melk | D7/607 |
| 5,562,228 | A | * | 10/1996 | Ericson | 62/457.2 |
| 5,641,199 | A | * | 6/1997 | Bond-Madsen | 297/229 |
| 5,857,778 | A | * | 1/1999 | Ells | 383/5 |
| 6,048,099 | A | * | 4/2000 | Muffett et al. | 383/20 |
| 6,068,402 | A | * | 5/2000 | Freese et al. | 383/110 |
| 6,074,093 | A | * | 6/2000 | Anderson | 383/4 |
| 6,220,473 | B1 | * | 4/2001 | Lehman et al. | 220/592.27 |
| 6,296,165 | B1 | * | 10/2001 | Mears | 224/610 |
| 6,415,947 | B1 | | 7/2002 | Kim | |
| 7,028,834 | B2 | * | 4/2006 | Karpel | 206/5 |
| 7,341,377 | B1 | * | 3/2008 | Baxter | 383/38 |
| 7,377,692 | B1 | * | 5/2008 | Troncoso et al. | 383/110 |
| 7,597,209 | B2 | * | 10/2009 | Rothschild et al. | 220/23.87 |
| 7,730,739 | B2 | * | 6/2010 | Fuchs | 62/457.7 |
| 2003/0010780 | A1 | * | 1/2003 | Redzisz | 220/6 |
| 2003/0221924 | A1 | * | 12/2003 | Tong | 190/107 |
| 2004/0035143 | A1 | * | 2/2004 | Mogil | 62/457.2 |
| 2005/0167428 | A1 | * | 8/2005 | Kellogg et al. | 220/9.4 |
| 2005/0263528 | A1 | * | 12/2005 | Maldonado et al. | 220/592.2 |
| 2008/0013867 | A1 | * | 1/2008 | Liu | 383/12 |
| 2008/0029425 | A1 | * | 2/2008 | Lebel et al. | 206/546 |

OTHER PUBLICATIONS

International Search Report and Opinion for Application No. PCT/US08/63551, dated Sep. 2, 2008, 9 pgs.

International Preliminary Report of Patentability for Application No. PCT/US08/63551, dated Nov. 26, 2009, 6 pgs.

* cited by examiner

FOLDABLE CARRYING CASE

RELATED APPLICATIONS

This application claims priority to and the benefit of U.S. Provisional Application Ser. No. 60/930,298, filed on May 14, 2007 by Nancy O. Myers, Michael O. Myers, Peter C. King, and Lisa A. King, entitled "Foldable Carrying Case" the entire disclosure of which is hereby incorporated by reference as if set forth in its entirety for all purposes.

BACKGROUND

The inventive subject matter disclosed herein relates to a foldable carrying case. The foldable carrying case may be used for any use for which a carrying case is used, such as a lunch box, picnic basket, sample case, etc. The carrying case can convert easily from a plane configuration to a container configuration, and vice versa.

Carrying cases, such as lunch boxes, are widely used and typically include a container with a handle for carrying one's lunch from home to school or work. Originally these carrying cases were manufactured entirely of steel. Later on lunch boxes were made of plastics.

Conventional lunch boxes, however, have several disadvantages. For example, the use of vinyl lunch boxes caused health concerns because they contained dangerously high levels of lead. Additionally, plastic lunch boxes are not durable and are difficult to clean because dirt may get trapped. For example, inner vinyl layers tear easily thereby exposing the inner layers of the lunch box and allowing mold to grow at the inner layers of the box. Moreover, they create an environment wherein sandwiches may get soggy. Additionally, lunches boxes that are made of soft materials do not protect the food from being squished.

Many carrying cases have been developed that are foldable or collapsible and various types of lunch boxes are known in the prior art. One example of a foldable lunch box is described in U.S. Pat. No. 1,451,468, which discloses a lunch box having metal panels that are pivotally connected with hinges. The lunch box is so constructed that the walls may be folded to the set up position to contain the lunch, and may be folded to a collapsed position so as to be flat. U.S. Pat. No. 1,537,760 discloses a folding box formed by a container member and a separate cover having a handle and locking means consisting of a pair of arms having latching hooks. Another example is disclosed in U.S. Pat. No. 2,239,611, describing a sheet metal lunch box folding into a practically flat and solid body. U.S. Pat. No. 2,760,669 discloses a folding lunch box whereof the box is collapsible and the cover may be slid onto the collapsed device. U.S. Pat. No. 2,792,144 discloses a foldable lunch box that forms a small flat package and a permanently attached cover. U.S. Pat. No. 2,844,272 discloses a collapsible lunch box with spring biased walls.

However, none of these prior attempts describes a one-piece foldable carrying case providing the durability, versatility, and hygienic advantages of the inventive subject matter.

Accordingly, there is a need for a carrying case that provides these advantages and that converts easily from a plane configuration to a container configuration, and vice versa.

SUMMARY

The inventive subject matter offers a solution for these problems by providing a carrying case with the following qualities, alone or in combination.

The inventive subject matter is directed to a foldable carrying case having an integrated one-piece body of hingeably connected panels, and flexible gussets hingeably connected to the panels, and the body provided with releasable fasteners. The body converts from a plane configuration to a container configuration, and vice versa. The container configuration is formed by folding the panels and the gussets, and the panels and gussets are connected by the releasable fasteners to prevent the container from unfolding. In the foregoing embodiment, the container configuration may have at least four sides. In the foregoing embodiment, at least one panel may be provided with a closed cell foam sheet. The foregoing embodiment may further include a stiffener sheet, and/or a woven layer, for example, a woven outer layer and a woven inner layer. In the foregoing embodiment, the gusset may have an outer layer and an inner layer. In the foregoing embodiment, at least one panel may include a padded material. In the foregoing embodiment, the panels and/or gussets may be provided with releasable fasteners. In the foregoing embodiment, the body may be provided with fasteners including grommets interacting with complementary fasteners to prevent the container from unfolding. In the foregoing embodiment, the gussets may be provided with straps having fasteners to facilitate forming the container. The foregoing embodiment may further be provided with a carrying strap, for example in the form of a side straps that assist in forming the container and to which a carrying strap extending from a right attachment panel to a left attachment panel may be attached. In the foregoing embodiment, the container configuration may have a cuboid shape forming a carrying case by folding the panels and the gussets into a container with hingeably connected lid. In the foregoing embodiment, the carrying case may have a releasable lid fastener for latching the lid to the container.

In another possible embodiment, a foldable carrying case may have an integrated one-piece body of hingeably connected panels and flexible gussets hingeably connected to the panels, and the body provided with releasable fasteners. The body converts from a plane configuration to a container configuration, and vice versa. The container configuration may have at least six sides formed by folding the panels and the gussets into a container with lid, and connecting the panels and gussets by the fasteners, the fasteners preventing the container from unfolding. The body is provided with side straps assisting in forming the container and in attaching a carrying strap extending from a right panel of the container to a left panel of the container. In the foregoing embodiment, the foldable gussets, connecting the side edges of the inner top panel and the front edges of the front right and front left side panels, may be provided with straps having fasteners.

The inventive subject matter further contemplates a method for making a foldable carrying case, by selecting a one-piece outer layer and a one-piece inner layer, selecting stiffener sheets and closed cell foam sheets, and forming an integrated one-piece body of multiple panels and gussets, each panel being formed by layering the stiffener sheet and the closed cell foam sheet, and covering the sheets with the outer layer on the side of the stiffener sheet and the inner layer on the side of the foam sheet. Subsequently, the outer layer and inner layer are connected around the sheets to form a single structure of interconnected individual panels, and the outer and inner layers are connected to form gussets in between the panels. The panels and gussets are provided with fasteners to removably connect the panels and gussets to form a container.

The inventive subject matter also contemplates a method for using a foldable carrying case with the steps of laying a carrying case in a plane configuration on a flat surface with its inner surface facing upwardly, raising a top panel and side panels, and folding gussets against the outer surface of the side panels, raising connected outer top panel and rear panel, and connecting the fasteners of the side panels to a handle attachment strap; raising the lid sides and attaching with fasteners to the front panel of the lid; raising the lid about a seam hinge and inserting the lid into the container formed by the panels; latching a closure loop around a closure button on the lid; and attaching a carrying strap to the handle attachment straps.

In another possible embodiment, the inventive subject matter is directed to a kit including a foldable carrying case and a plurality of storage containers dimensioned to occupy substantially all of the space within the carrying case. The kit may further include a cooling element.

These and other embodiments are described in more detail in the following detailed descriptions and the figures.

The foregoing is not intended to be an exhaustive list of embodiments and features of the inventive subject matter. Persons skilled in the art are capable of appreciating other embodiments and features from the following detailed description in conjunction with the drawings.

BRIEF DESCRIPTION OF THE DRAWINGS

The following figures show embodiments according to the inventive subject matter, unless noted as showing prior art.

DETAILED DESCRIPTION

Figure 1:
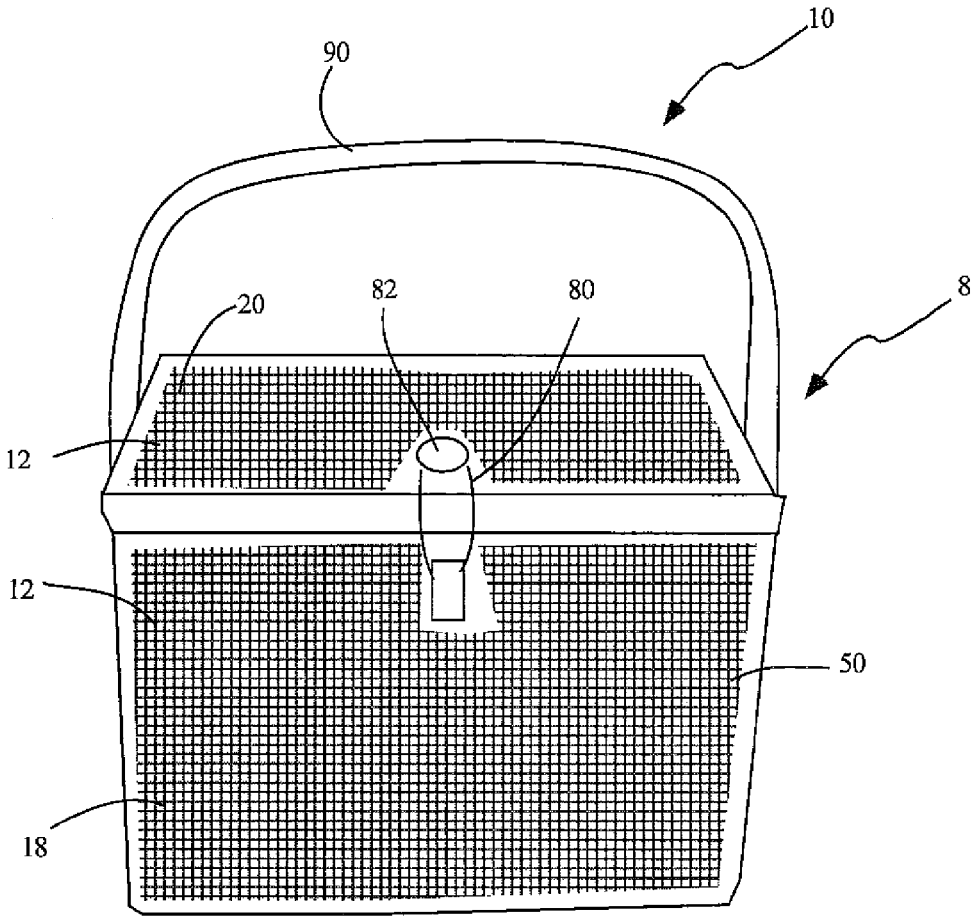
FIG. 1 shows a simplified front perspective view of a foldable carrying case in its completely erected configuration.

Representative embodiments according to the inventive subject matter are shown in FIGS. 1-12, wherein the same or generally similar features share common reference numerals.

The inventive subject matter is directed to a novel foldable carrying case that can convert easily from a plane configuration to a container configuration, and vice versa. The carrying case has a simple construction with a minimum number of parts. The flat or plane configuration allows for convenient storage. It allows for easy cleaning, for example, by sponge, or by placing the case in its flat configuration in a washing machine. The plane configuration also allows the case to double as a sitting mat or placemat. These carrying cases may be adapted to be used as lunch boxes, for picnics, as bicycle-friendly packs, etc.

The foldable carrying case has an integrated one-piece body of hingeably connected panels and flexible gussets hingeably connected to the panels. The body is further provided with releasable fasteners. As further described below, the container configuration is reached by folding the panels and the gussets, and connecting the panels and gussets with releasable fasteners to prevent the container from unfolding. In one possible embodiment, the body may convert into a container configuration having at least four sides. The container configuration may be designed as an open container or a closed container. The carrying case may be used with or without a carrying strap, for example a carrying strap provided with a detachable fastener may be connected to the sides of the container.

As used herein, a panel is a distinct section of the carrying case body, which may be rectangular or triangular or any other shape adapted to form a section of the carrying case. The panel may be formed of a single layer of material or of multiple layers as further described below. The panel may be rigid, substantially rigid, or have a degree of flexibility, while allowing defining the shape of the carrying case and holding the shape when carried and holding items. The body of the carrying case may be formed of any combination of one or more panels. Although, the carrying case described below is describes as having a cuboid shape, the case may have any shape or form, for example, the container of the carrying case may take any of the volumetric shapes shown in FIGS. 12*a-e*. The carrying case can be shaped and adapted to open in different directions. The term gusset refers to a span of material that interconnects panels. For example, the gusset may be a triangular insert, of a webbed or woven material, between the panels that is part of the carrying case body, and that provides additional strength and flexibility in between panels.

Figure 2:
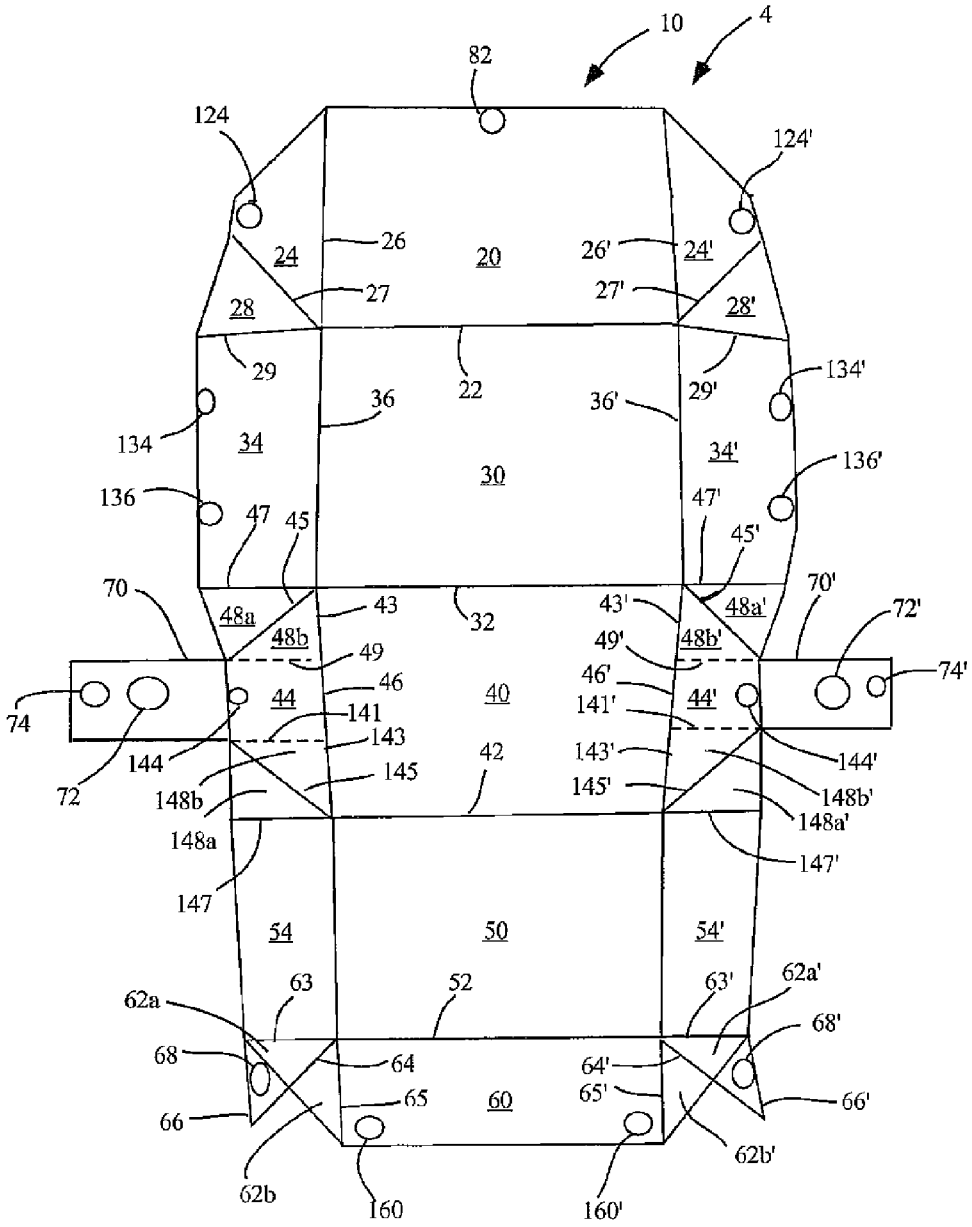
FIG. 2 shows a top plan view of the interior of the foldable carrying case of FIG. 1 shown its completely un-erected configuration.
Figure 3:
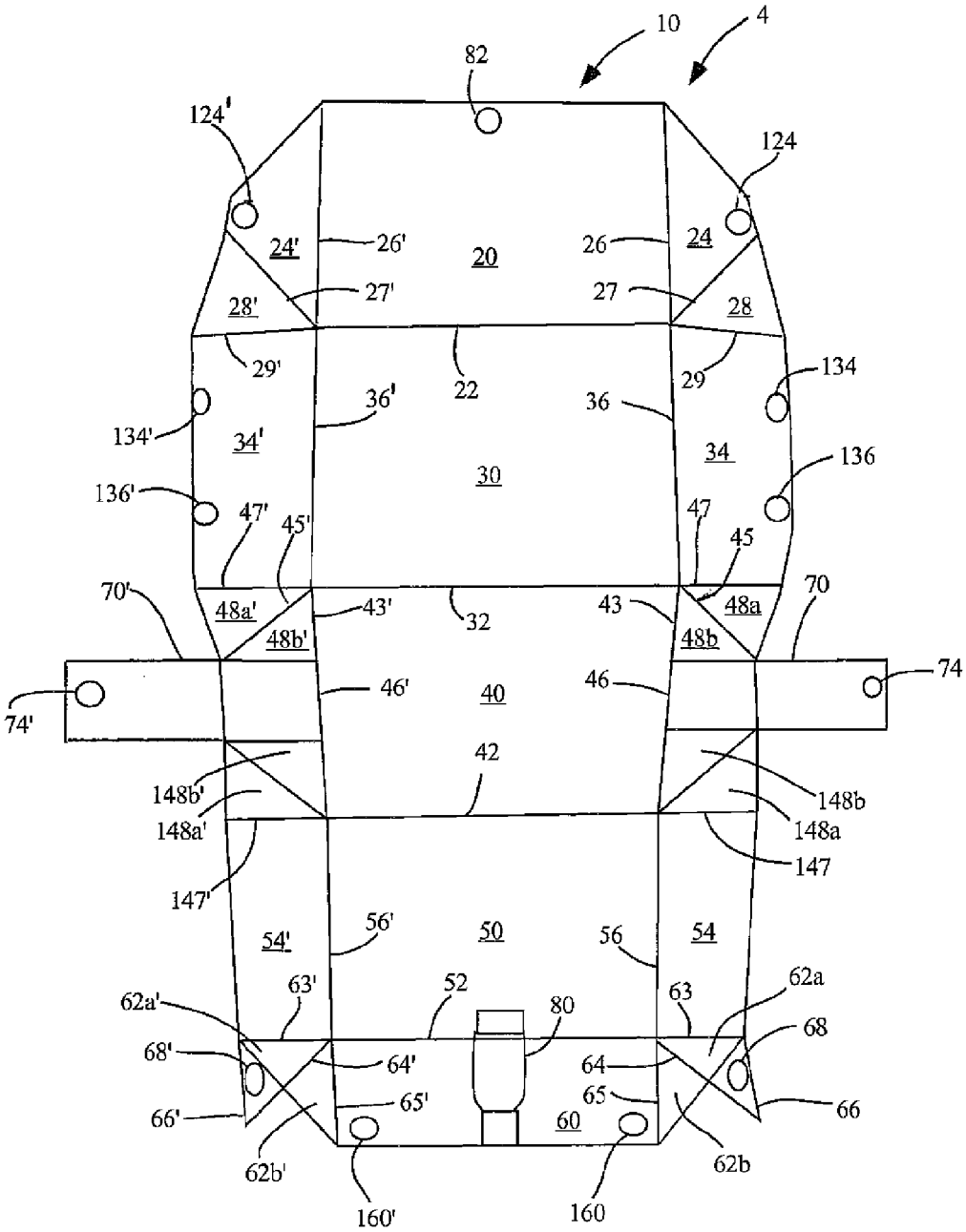
FIG. 3 shows a top plan view of the exterior of the foldable carrying case of FIG. 1 shown its completely un-erected configuration.

FIGS. 1-12 demonstrate the general operation of the inventive subject matter. A foldable carrying case 10 according to the inventive subject matter is shown in its completely erected, carrying configuration in FIG. 1 and FIGS. 5-8. The foldable carrying case 10 is shown in its completely un-erected, flat configuration in FIGS. 2 and 3. FIG. 2 shows the interior surface of the foldable carrying case 10, and FIG. 3 shows the exterior surface of the foldable carrying case 10. FIGS. 2 and 3 illustrate how carrying case 10 is formed by a body 4 of hingeably connected panels 12 and flexible gussets 14 that are hingeably connected to panels 12. The container configuration 8 is reached by folding panels 12 and gussets 14 into a container 18 with lid 20. Panels 12 and gussets 14 are connected by fasteners 16 and fasteners in the form of grommets 19 that interact with complementary fasteners 16 to prevent the container 18 from unfolding. A grommet refers to any kind of ring or eyelet of metal or other suitable material. Fasteners 16 are shown as snap fasteners, having mating male (stud) and female (socket) snap fasteners, located on the various panels, allowing the panels to be releasably fastened with a clicking or snapping sound. One example of fasteners, such as post style fasteners 15 interact with complementary fasteners, such as grommets 19. Specific snap fasteners may be selected to allow easy release, for example some types of fasteners allow easy opening when pulled on at one side, but resist opening when approached and pulled at the other side.

Although snap fasteners are described in the embodiments below, any other suitable releasable fasteners may be used, such as magnets, hooks and/or eye structures, for example hook and loop fasteners sold under the trademark VELCRO™

Figure 4:
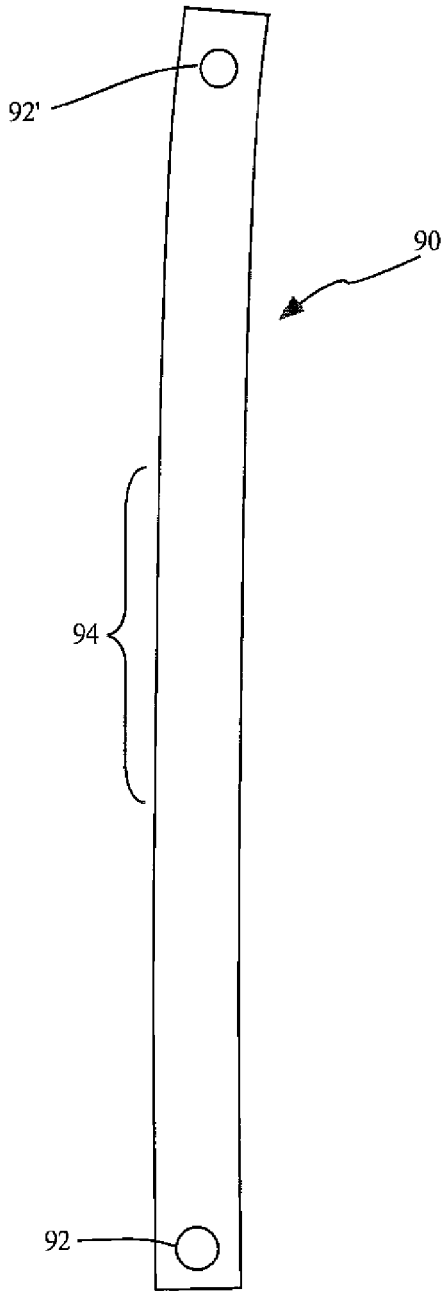
FIG. 4 shows a top plan view of the carrying strap of the foldable carrying case of FIG. 1.

The container of the carrying case is formed by a bottom panel 40, a rear panel 30, an outer top panel 20, and side panels, as further described below, to be folded upwardly from their flattened configuration into a box-like configuration. As shown in FIGS. 2, 3, 5, 7-9 body 4 may be provided with side straps 21 that assist in forming container 18 and attach to carrying strap 90, extending from a right panel of container 18 to a left panel of container 18. A carrying strap 90, such as a nylon webbing strap shown in FIG. 4, may attach to the outer sides of the carrying case and extend over the outer top panel. The carrying strap 90 may attach to side straps 21 with a snap closure 91, as shown in FIG. 4, or a buckle 88, as shown in FIGS. 5-8, for example, or any other suitable means.

Figure 5:
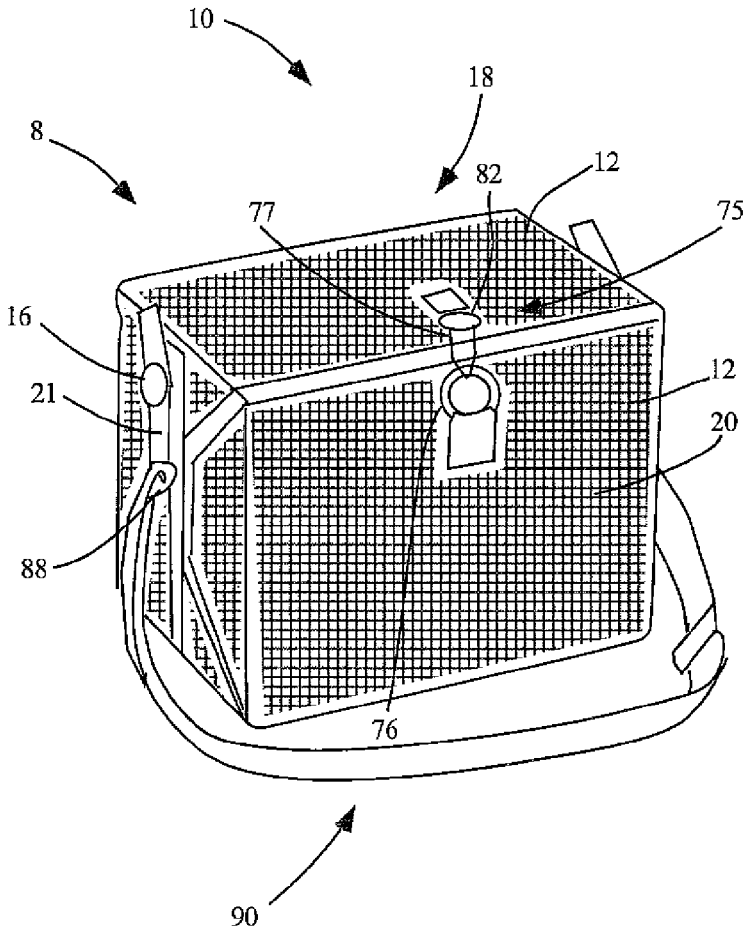
FIG. 5 shows a perspective view of another embodiment of a foldable carrying case in its completely erected configuration.
Figure 6:
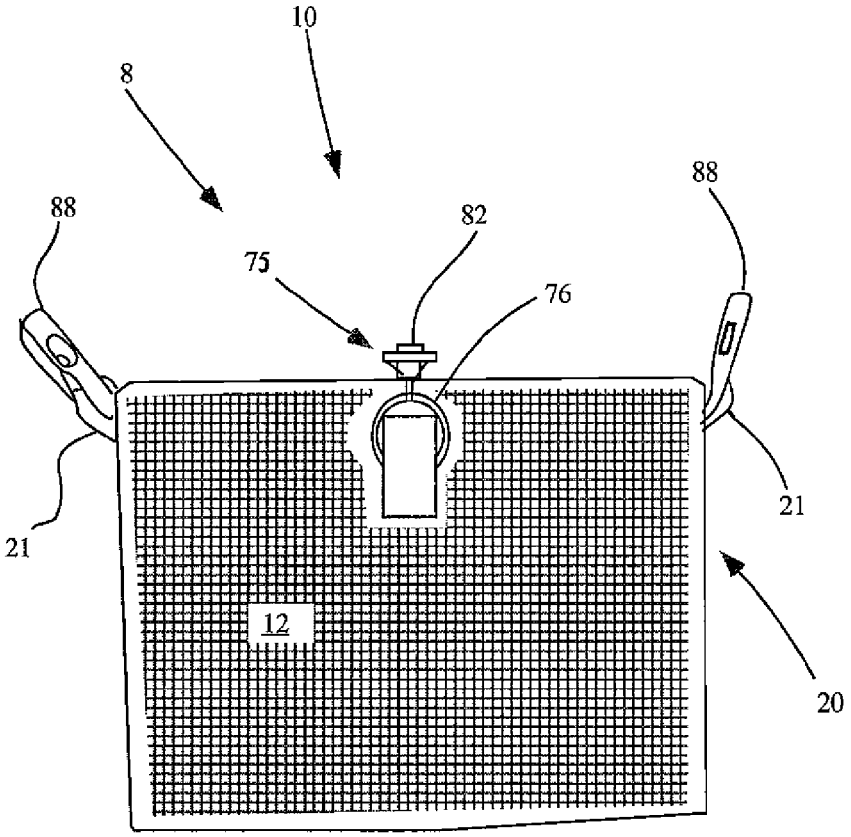
FIG. 6 shows a front view of the carrying case of FIG. 5.
Figure 7:
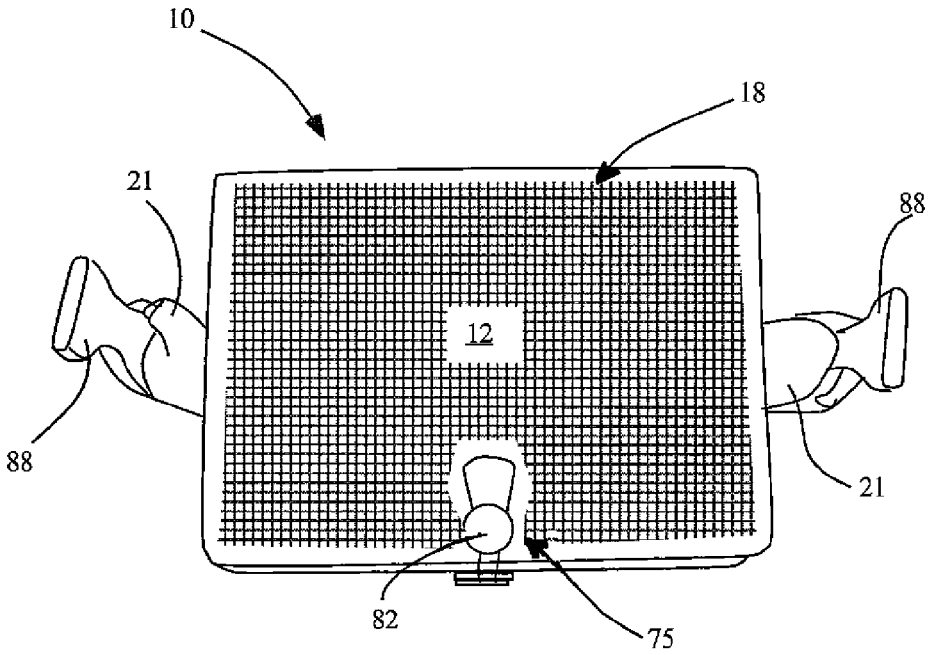
FIG. 7 shows a top view of the carrying case of FIG. 5.
Figure 8:
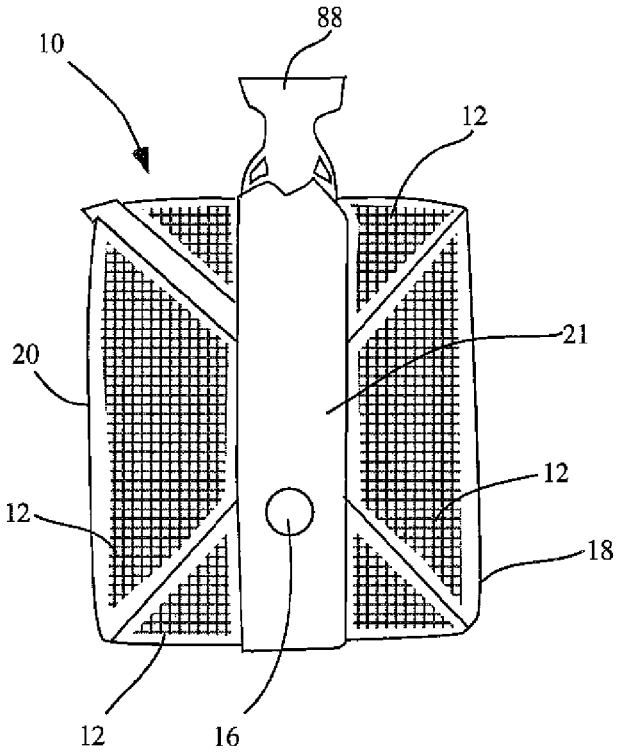
FIG. 8 shows a side view of the carrying case of FIG. 5.

The lid of the carrying case is formed by an inner top panel, a front panel, and front right and front left side panels. The inner top panel and the side panels are attached to the front panel along seams that act as hinges and allow the inner top panel, side panels and front panel to be erected into a box-like lid from their collapsed, flattened configuration. Foldable gussets connect the side edges of the inner top panel and the front edges of the front right and front left side panels. FIG. 1 and FIGS. 5-7 show a lid 20 and container 18 provided with a releasable lid fastener 75. FIGS. 5-7 show a lid fastener 75 that consists of a button 82 attached to outer top panel 20, a D-ring 76 attached to front panel 50, and an elastic loop 77 attached to D-ring 76. Elastic loop 77 interacts with button 82 to close the container. The lid and container may be releasably held together by any suitable means. For example, in another embodiment, a strap and closure loop as described below, may be used.

FIGS. 1-3 illustrate how in one possible embodiment a carrying case is formed of several interacting panels and interconnecting gussets that span between panels. An outer top panel 20 is foldably connected to rear panel 30 along seam hinge 22. Rear panel 30 is foldably connected to bottom panel 40 along a seam hinge 32. Bottom panel 40 is foldably connected to front panel 50 along seam hinge 42. Front panel 50 is foldably connected to inner top panel 60 along seam hinge 52.

Right triangular-shaped side flap 24 is foldably connected to outer top panel 20 along seam hinge 26, and left triangular-shaped side flap 24' is foldably connected to outer top panel 20 along seam hinge 26'. A right grommet 124 is located adjacent the apex of right triangular-shaped side flap 24 and provides an opening there through. A left grommet 124' is located adjacent the apex of left triangular-shaped side flap 24' and provides an opening there through.

Rear right side panel 34 is foldably connected to rear panel 30 along seam hinge 36, and rear left side panel 34' is foldably connected to rear panel 30 along seam hinge 36'.

A right post style male snap fastener component 134 is attached to rear right side panel 34 adjacent its outer edge with its shaft extending outwardly from the outer surface of rear right side panel 34. A left post style male snap fastener component 134' is attached to rear left side panel 34' adjacent its outer edge with its shaft extending outwardly from the outer surface of rear left side panel 34'.

Positioned forwardly of right post style male snap fastener component 134 is right male component (stud) 136 of a snap fastener, which is attached to rear right side panel 34 adjacent its outer edge with its stud extending outwardly from the outer surface of rear right side panel 34. Positioned forwardly of left post style male snap fastener component 134' is left male component (stud) 136' of a snap fastener, which is attached to rear left side panel 34' adjacent its outer edge with its stud extending outwardly from the outer surface of rear left side panel 34'.

Right strap attachment panel 44 is foldably connected to bottom panel 40 along seam hinge 46, and left strap attachment panel 44' is foldably connected to bottom panel 40 along seam hinge 46'.

A right female snap connector component (socket) 144 is attached to right strap attachment panel 44 adjacent its outer edge with its stud receiving portion facing upwardly from the inner surface of right strap attachment panel 44. A left female snap connector component (socket) 144' is attached to left strap attachment panel 44' adjacent its outer edge with its stud receiving portion facing upwardly from the inner surface of left strap attachment panel 44'.

Front right side panel 54 is foldably connected to front panel 50 along seam hinge 56, and front left side panel 54' is foldably connected to front panel 50 along seam hinge 56'.

Right triangular-shaped gusset 28 is foldably connected to right side flap 24 along seam hinge 27, and foldably connected to rear right side panel 34 along seam hinge 29. Left triangular-shaped gusset 28' is foldably connected to left side flap 24' along seam hinge 27' and foldably connected to rear left side panel 34' along seam hinge 29'.

Right rear triangular-shaped gusset portion 48*a* is foldably connected to rear right side panel 34 along seam hinge 47, and foldably connected to right rear triangular-shaped gusset portion 48*b* along seam hinge 45. Right rear triangular-shaped gusset portion 48*b* is foldably connected to bottom panel 40 along seam hinge 43, and foldably connected to right strap attachment panel 44 along seam hinge 49.

Right front triangular-shaped gusset portion 148*a* is foldably connected to front right side panel 54 along seam hinge 147, and foldably connected to right front triangular-shaped gusset portion 148*b* along seam hinge 145. Right front triangular-shaped gusset portion 148*b* is foldably connected to bottom panel 40 along seam hinge 143. Right front triangular-shaped gusset portion 148*b* is foldably connected to right strap attachment panel 44 along seam hinge 141.

Left rear triangular-shaped gusset portion 48*a'* is foldably connected to rear left side panel 34' along seam hinge 47', and foldably connected to right rear triangular-shaped gusset portion 48*b* along seam hinge 45'. Left rear triangular-shaped gusset portion 48*b'* is foldably connected to bottom panel 40 along seam hinge 43', and foldably connected to left strap attachment panel 44' along seam hinge 49'.

Left front triangular-shaped gusset portion 148*a'* is foldably connected to front left side panel 54' along seam hinge 147', and foldably connected to left front triangular-shaped gusset portion 148*b'* along seam hinge 145'. Left front triangular-shaped gusset portion 148*b'* is foldably connected to bottom panel 40 along seam hinge 143'. Left front triangular-shaped gusset portion 148*b'* is foldably connected to left strap attachment panel 44' along seam hinge 141'.

Right inner top triangular-shaped gusset portion 62*a* is foldably connected to front right side panel 54 along seam hinge 63, foldably connected to triangular-shaped gusset portion 62*b* along seam hinge 64, and foldably connected to inner top panel 60 along seam hinge 65. Left inner top triangular-shaped gusset portion 62*a'* is foldably connected to front left side panel 54' along seam hinge 63', foldably connected to triangular-shaped portion 62*b'* along seam hinge 64', and foldably connected to inner top panel 60 along seam hinge 65'.

Triangular-shaped portion 62*a* of right inner top gusset 62 has a triangular-shaped pull tab 66 extending therefrom, and triangular-shaped portion 62*a*' of left inner top gusset 62' has a triangular-shaped pull tab 66' extending therefrom. Pull tabs 66, 66' have male snap fastener components 68, 68', respectively, attached thereto with the stud portions thereof extending upwardly from the outer surfaces of pull tabs 66, 66'. In another possible embodiment, pull tabs 66 and 66' may be rectangular straps provided with male snap fastener components 68 and 68'.

Right and left female snap fastener components (sockets) 160, 160' are attached to top inner panel 60 adjacent the right and left ends, respectively, and adjacent the outer edge of inner top panel 60. The stud receiving sockets of right and left female snap fastener components (sockets) 160, 160' face upwardly from the interior surface of inner top panel 60.

Right handle attachment strap 70 is attached to right strap attachment panel 44, and extends outwardly substantially perpendicular to the outer edge thereof. The female portion (socket) 72 of a post style snap fastener is attached to the middle portion of right handle attachment strap 70 with its post receiving socket facing upwardly from the inner surface of right handle attachment strap 70. The male portion (stud) 74 of a snap fastener is attached to the outer portion of right handle attachment strap 70 with its stud facing upwardly from the outer surface of right handle attachment strap 70.

Left handle attachment strap 70' is attached to left strap attachment panel 44', and extends outwardly substantially perpendicular to the outer edge thereof. The female portion (socket) 72' of a post style snap fastener is attached to the middle portion of left handle attachment strap 70' with its post receiving socket facing upwardly from the inner surface of left handle attachment strap 70'. The male portion (stud) 74' of a snap fastener is attached to the outer portion of left handle attachment strap 70' with its stud facing upwardly from the outer surface of left handle attachment strap 70'.

Carrying strap 90 has right and left socket portions 92, 92' of a snap closure located at each end which are releasably connected to studs 74, 74' located on right and left handle attachment straps 70, 70'. The middle portion 94 of carrying strap 90 contains a resilient filler adapted to make it more comfortable to carry the foldable carrying case 10. Carrying strap 90 can be swiveled at the snap closure locations. Although the embodiments shown in the Figures have carrying strap 90 releasably attached to carrying case 10, other embodiments may have a handle strap permanently affixed thereto.

The inventive subject matter further contemplates a method for using such a carrying case. Carrying case 10 may be folded from the un-erected configuration shown in FIGS. 2 and 3 into the container configuration shown in FIG. 1 and FIGS. 5-9. The conversion may be accomplished by the following steps:

A. Lay the un-erected carrying case 10 on a flat surface with its inner surface facing upwardly, as seen in FIG. 2.

B. Raise right side panels 34, 54, right side flap 24, and right strap attachment panel 44 about 90 degrees.

C. Raise left side panels 34', 54', left side flap 24', and left strap attachment panel 44' about 90 degrees.

D. Raise outer top panel 20 and right and left side flaps 24, 24' while folding right and left gussets 28, 28' against the outer surfaces of rear right and rear left side panels 34, 34' and passing the post style male snap fasteners 134, 134' through grommet holes 124, 124'.

E. Raise the now connected together outer top panel 20, right and left flaps 24, 24', and rear panel 30 about seam hinge 32 about 90 degrees, bringing studs 136, 136' into alignment with sockets 144, 144' and snapping them together.

F. Raise right handle attachment strap 70 and snap the post style fastener 134 to socket 72. Raise left handle attachment strap 70' and snap the post style fastener 134' to socket 72'.

G. Raise inner top panel 60 upwardly about 90 degrees bringing socket 160 into alignment with stud 68 and snap locking them together, and bringing socket 160' into alignment with stud 68' and snap locking them together. This step is illustrated, for example, in FIG. 9.

H. Raise about seam hinge 42 the now connected together inner top panel 60, front panel 50, and front right and left side panels 54, 54' about 90 degrees, and insert into the case formed by outer top panel 20, rear panel 30, bottom panel 40, side panels 34, 34', and flaps 24, 24' until seam hinge 52 is in alignment with the outer edge of outer top panel 20.

I. Latch closure loop 80 around closure button 82.

J. Attach carrying strap 90 by snapping studs 74, 74' into sockets 92, 92'.

Figure 13:
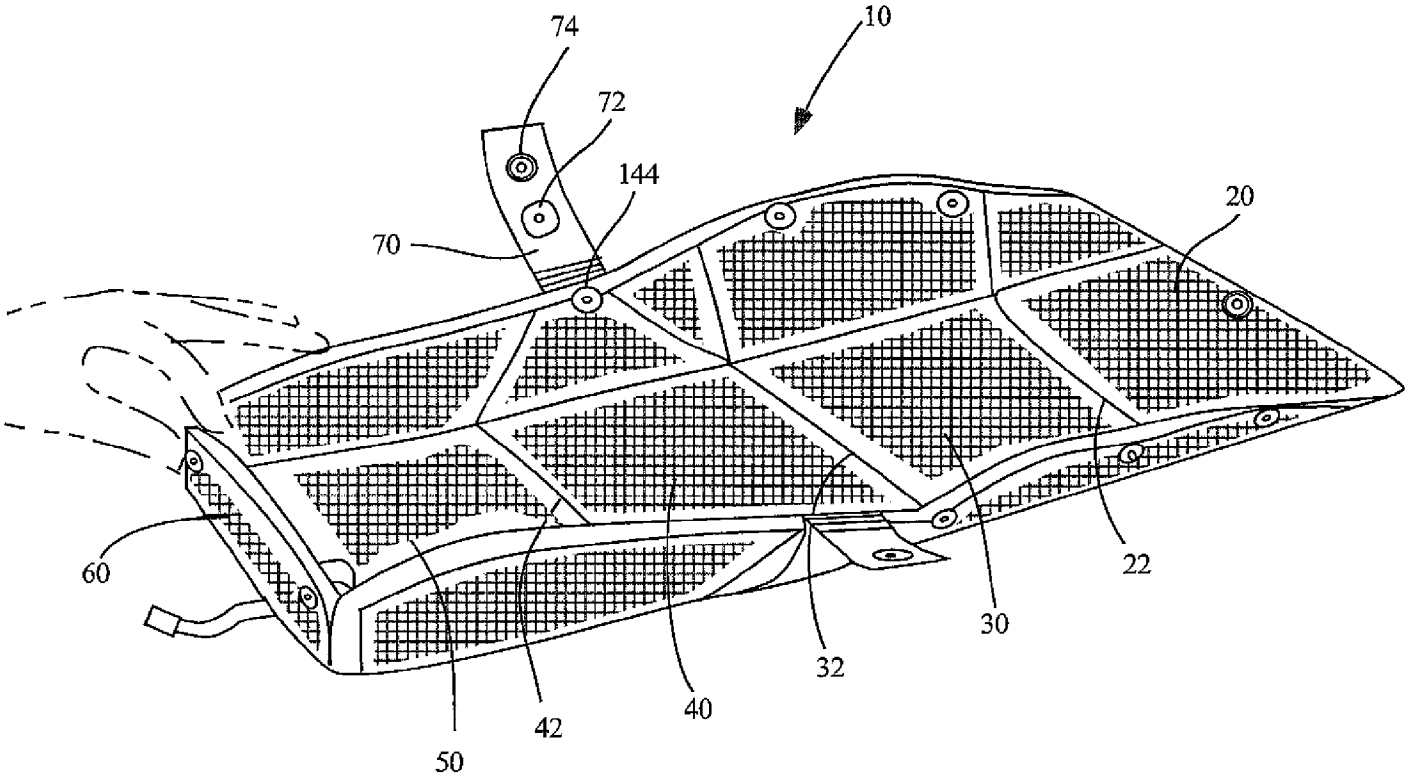
FIG. 13-18 illustrate conversion of a plane configuration to a container configuration of a carrying case similar to the carrying case shown in FIGS. 2 and 3.
Figure 14:
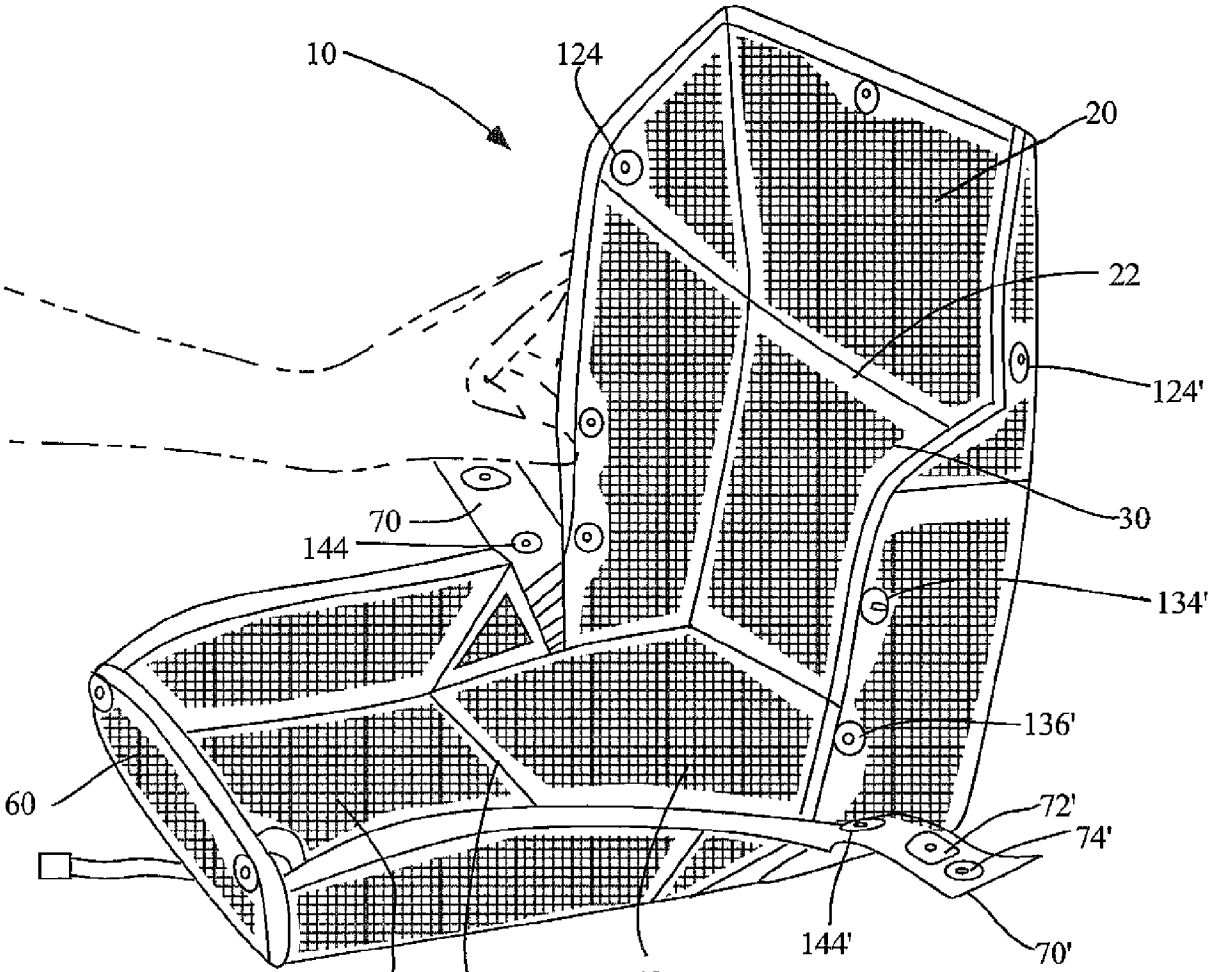
Figure 15:
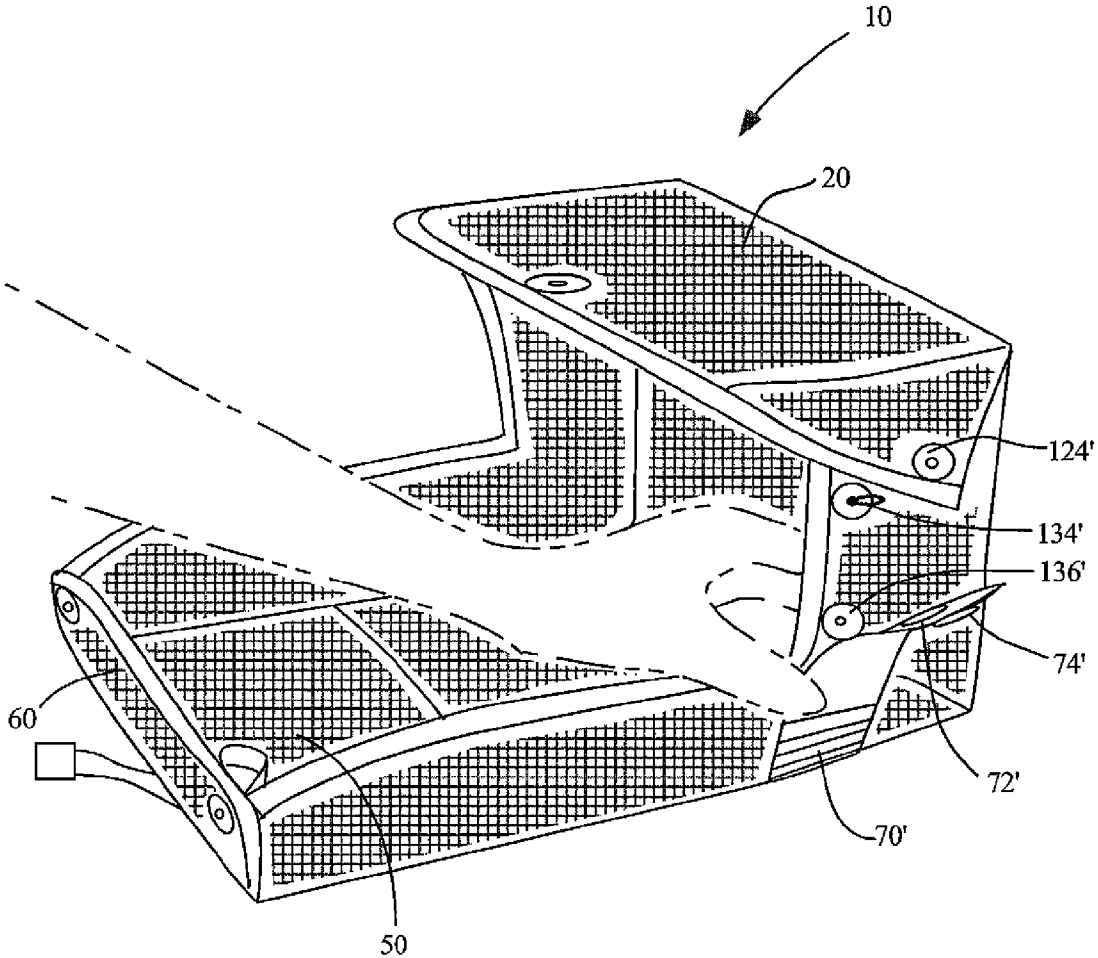
Figure 16:
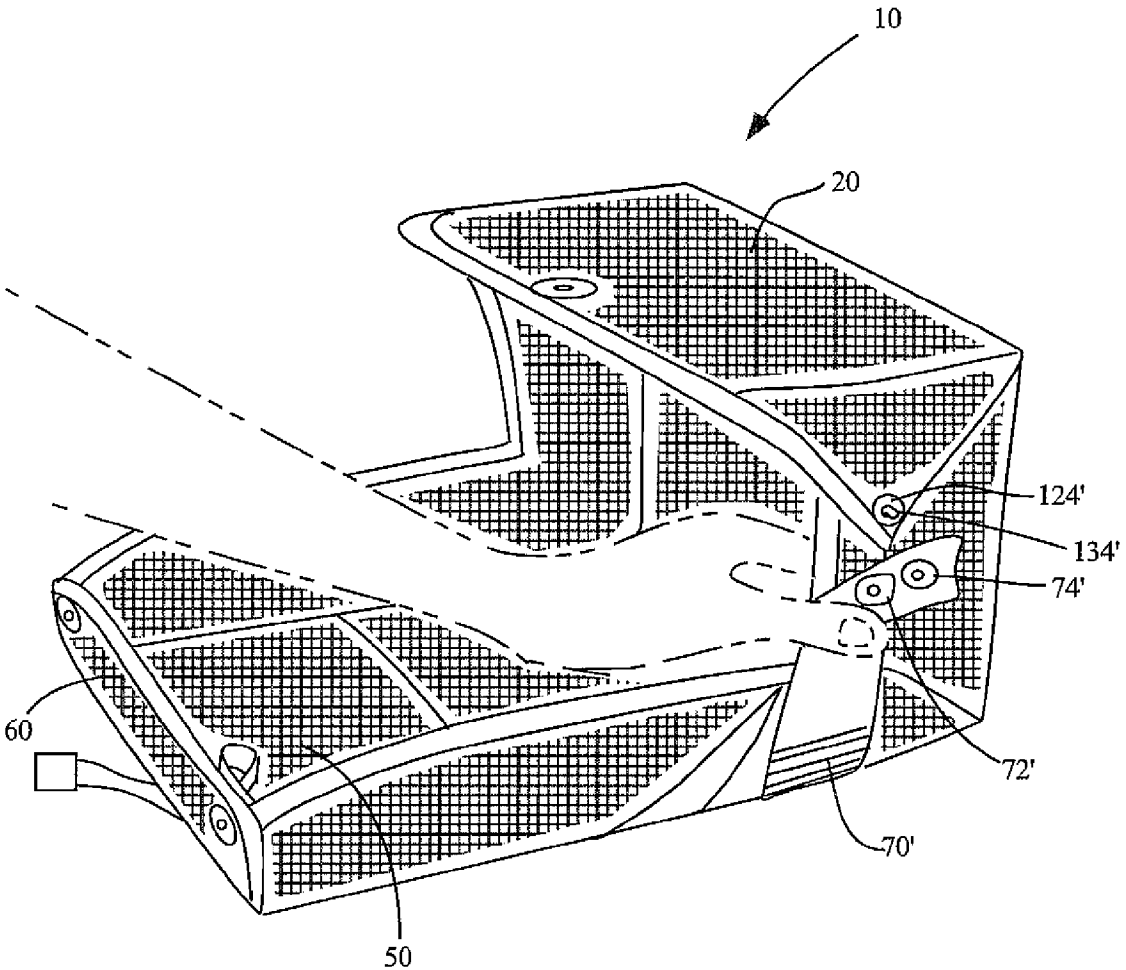
Figure 17:
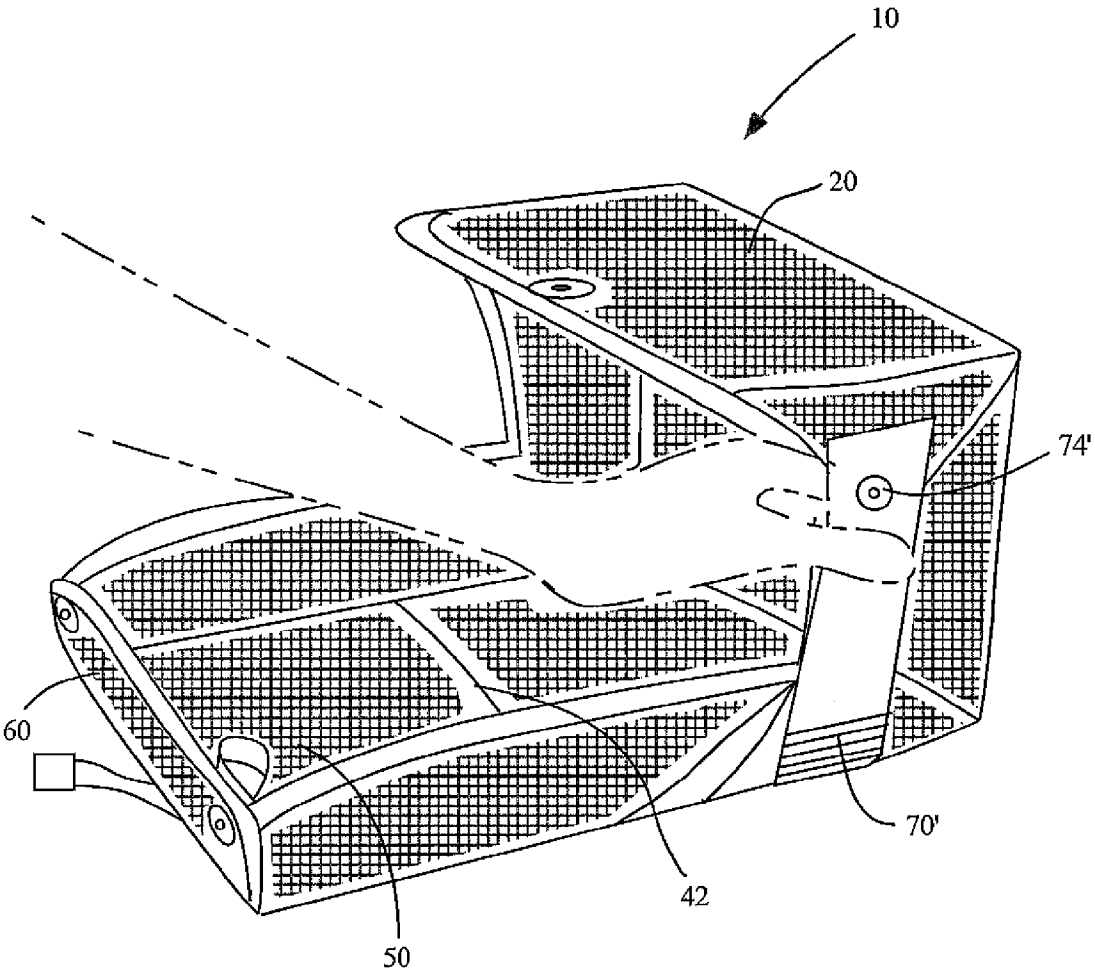
Figure 18:
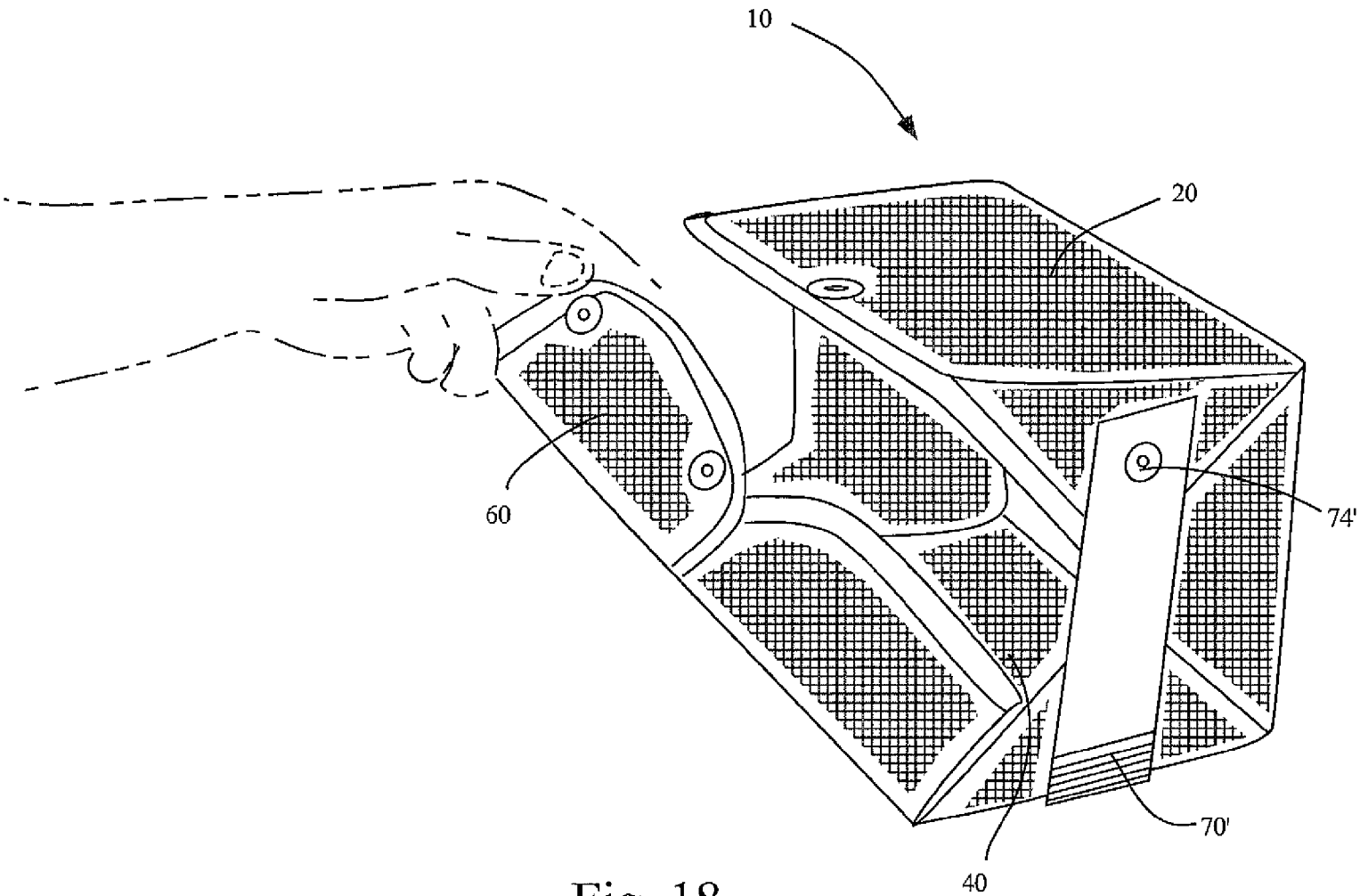

To unfold carrying case 10, steps A-J can be reversed. These steps illustrate only one way of erecting the folding case, however, the conversion form a plane configuration to a container configuration may be accomplished in several ways. For example, in step H, front panel 50 and right and left side panels 54, 54' may be raised and fold at the outside of the case until seam hinge 52 is in alignment with the outer edge of outer top panel 20, instead of inserting front panel 50 into the case. In another example, the conversion may be accomplished by switching the order of steps A-J, as illustrated by FIGS. 13-18. FIG. 13 shows how first the lid is formed by raising inner top panel 60, as described in step G. FIGS. 14-17 shows how the container is formed by raising rear panel 30 to form the container as described in steps B-E. FIG. 18 illustrated how subsequently panels 50 and 60 are raised about seam hinge 42 to close the container and as described in step H.

To place items into carrying case 10 the bottom panel 40 of the container is placed on a flat surface. The closure loop 80 is unfastened from button 82, and the lid portion formed by inner top panel 60, front panel 50, and front right and left side panels 54, 54', is lowered about seam hinge 42 to provide access to the container portion formed by outer top panel 20, rear panel 30, bottom panel 40, rear right and left side panels 34, 34', and right and left flaps 24, 24'. After items are placed into the container portion, the lid portion is raised about seam hinge 42 and partially inserted into the container portion, and closure loop 80 is reattached to button 82. The carrying case 10 is then picked up by carrying strap 90, and the carrying case 10 transported to its destination. To remove items from carrying case 10 the foregoing procedure is reversed, and the lowered lid portion can be used as a tray.

Figure 11:
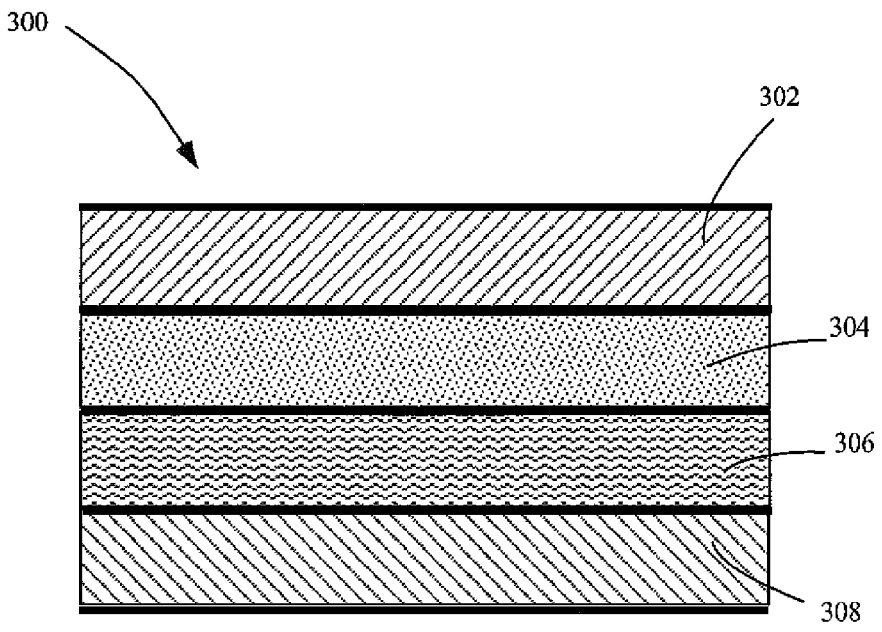
FIG. 11 shows a simplified cross section of a panel of a foldable carrying case.
Figure 12A:
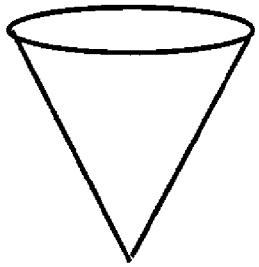
FIG. 12*a-d* illustrate examples of different volumetric shapes which a container configuration of a carrying case according to the inventive subject matter may have.
Figure 12B:
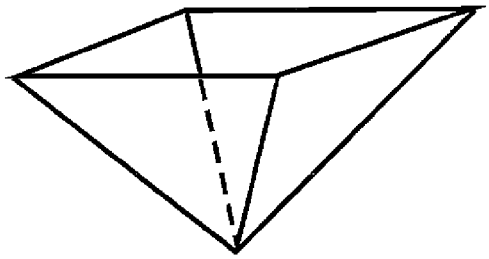
Figure 12C:
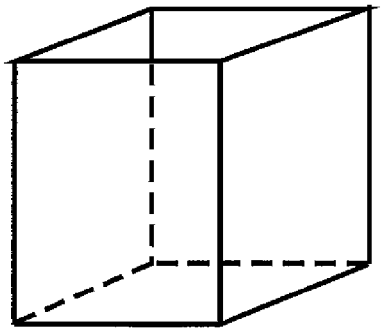
Figure 12D:
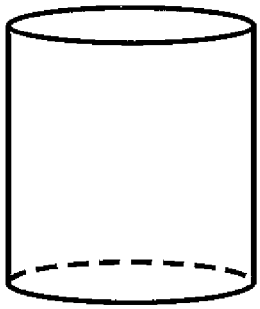

In one possible embodiment, at least one panel has a padded material or soft sided body portions. In another possible embodiment, the panels are formed as a substantially rigid construction of multiple layers. For example, each panel is formed by layering a stiffener sheet and a closed cell foam sheet, and covering the sheets with an outer layer on the side of the stiffener sheet and an inner layer on the side of the foam sheets. As illustrated in FIG. 11, a multiple layer panel construction 300 may include an outer layer 302, two middle layers 304 and 306, and an inner layer 308. A durable outer layer 302 of a flexible and washable material may be used, for example a fabric exterior layer of the type sold under the trademark Cordura™. Middle layers 304 and 306 may be made of a stiffener sheet such as polyethylene film, and an insulating, non-absorbent layer of polyethylene closed cell foam ("Insulite"), for example. The inner layer 308 may be made of a washable woven material, such as a nylon taffeta interior layer or Oxford cloth. The use of a woven material as inner and/or outer layers has several advantages. A layer of such a material is easily washable and has rip stop qualities. Such a woven layer does not tear as easily compared with, for example, a vinyl layer, which may be pierced easily by a fork. Using a layered construction of these materials for the panels results in a durable and light weight carrying case.

The inventive subject matter is further directed to a method for making such a carrying case. A foldable carrying case may be made by selecting different layers, such as a one-piece outer layer and a one-piece inner layer, and stiffener sheets and closed cell foam sheets to form an integrated one-piece body of multiple panels and gussets. The outer layer and inner layer are connected together, for example by stitching around the sheets to form a single structure of interconnected individual panels. Gussets may be formed in between the panels by stitching the outer and inner layers, without inserts. The panels and gussets are provided with releaseable fasteners. In the illustrated embodiments, two grommets interacting with fasteners to removably connect the panels and gussets. Subsequently, the lid and container are provided with a releasable lid fastener to removably connect the lid and container. Finally, the body may be provided with a carrying strap. According to this method, the body may be formed by stitching the layered construction to form panels and gusssets, or by connecting these layers and panels by any other suitable means.

The foldable carrying cases according to the inventive subject matter may come in several dimensions and sizes. For example, smaller sizes may accommodate children's lunches, while larger cases may carry a lunch together with a snack. The foldable carrying case can be custom made.

Figure 9:
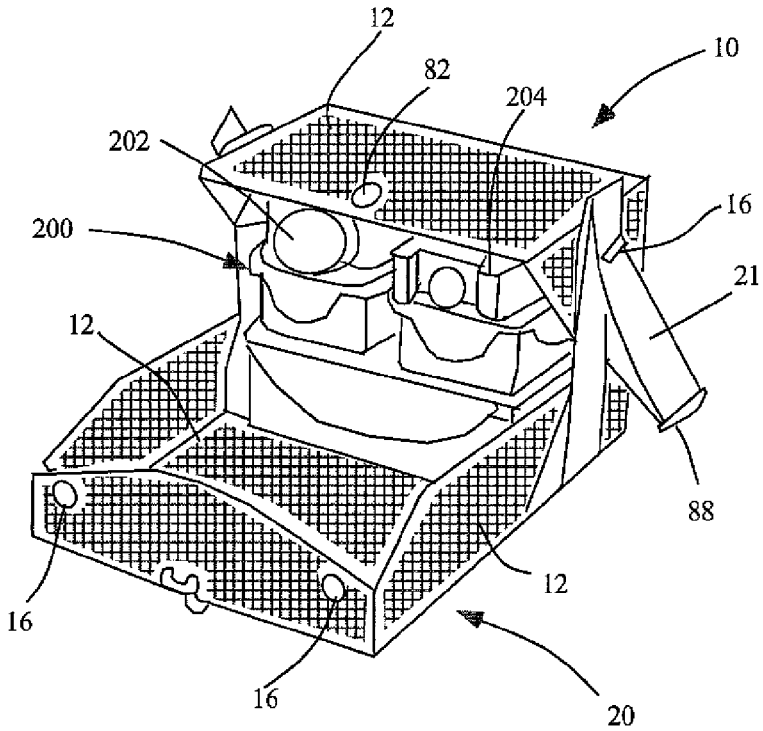
FIG. 9 shows a perspective view of the carrying case of FIG. 5 with the lid folded open, showing three storage containers, a cooling element, and a drink bottle.
Figure 10:
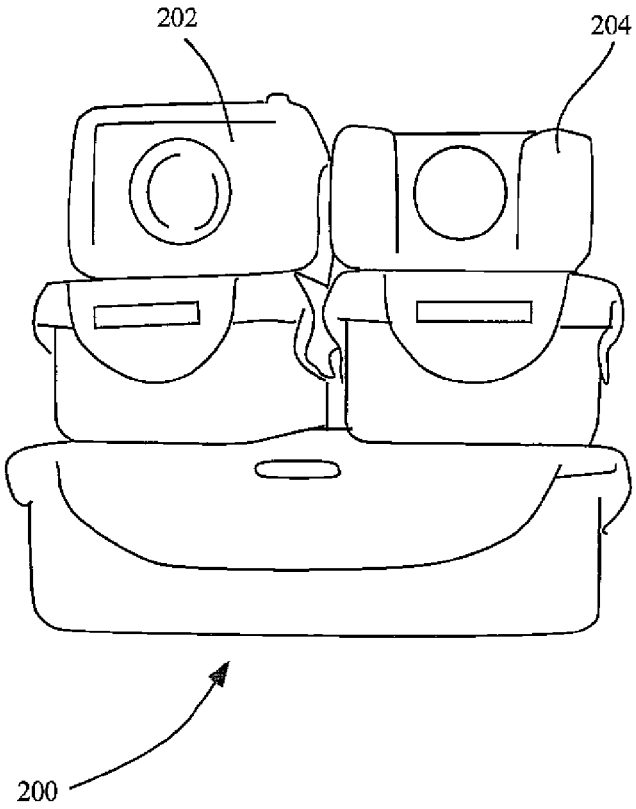
FIG. 10 shows a front view of the storage containers, a cooling element, and a drink bottle as they are stacked to fit within the foldable carrying case of FIG. 5.

In another possible embodiment, the inventive subject matter is directed to a kit including a foldable carrying case and a plurality of storage containers adapted to occupy substantially all of the space within the carrying case. For example, as illustrated in FIGS. 9 and 10, a carrying case is provided with three small plastic containers 200 for food, a drink bottle 202, and a cooling element 204 to fit neatly within the case. Plastic food storage containers, such as rectangular Lock&Lock™ containers, described in U.S. Pat. No. 6,415,947, and available at www.LockAndLockUSA.com, may be used. In other possible embodiments, for example larger sized carrying cases may be adapted to contain a wide mouth Thermos™.

Persons skilled in the art will recognize that many modifications and variations are possible in the details, materials, and arrangements of the parts and actions which have been described and illustrated in order to explain the nature of the inventive subject matter, and that such modifications and variations do not depart from the spirit and scope of the teachings and claims contained therein.

All patent and non-patent literature cited herein is hereby incorporated by references in its entirety for all purposes.

The invention claimed is:

1. A foldable carrying case, comprising:

an integrated one-piece body having a plurality of panels hingeably connected to each other, and a plurality of flexible gussets hingeably connected to the panels, and a plurality of releasable fasteners;

the body convertible from a plane configuration to a container configuration, and vice versa; and the container configuration formed by rotating one or more of the panels relative to at least one other of the panels and folding the corresponding gussets, the panels and gussets being releasably retained in the container configuration by the releasable fasteners to prevent the body from unfolding from the container configuration;

wherein the plurality of panels comprises a front panel positioned between and hingeably connected to a pair of opposed side panels, and positioned between and hingeably connected to a bottom panel and a top inner panel, wherein the top inner panel defines a distal edge spaced apart from the front panel;

wherein the plurality of flexible gussets comprises a respective flexible gusset extending between the distal edge of the top inner panel and each of the opposed side panels;

wherein the top inner panel and the flexible gussets extending between the top inner panel and the opposed side panels are configured to retain the top inner panel and the opposed side panels generally perpendicular to the front panel when the front panel is unfolded from the container configuration.

2. The case of claim 1, wherein at least one panel comprises a closed cell foam sheet.

3. The case of claim 2, wherein at least one panel comprises a stiffener sheet.

4. The case of claim 3, wherein at least one panel comprises at least one woven layer.

5. The case of claim 4, wherein the at least one woven layer comprises a woven outer layer and a woven inner layer.

6. The case of claim 1, wherein the gussets comprise an outer layer and an inner layer.

7. The case of claim 1, wherein at least one panel comprises a padded material.

8. The case of claim 1, wherein at least one of the releasable fasteners is positioned on a respective at least one of the panels.

9. The case of claim 1, wherein at least one of the releasable fasteners comprises a first fastener component and a second fastener component, wherein the first fastener component is matingly engageable with the second fastener component and adjoins one of the gussets extending between the distal edge of the top inner panel and the opposed side panels.

10. The case of claim 1, wherein at least one of the fasteners comprises a corresponding grommet configured to matingly engage a complementary fastener so as to prevent the container from unfolding.

11. The case of claim 1, wherein at least one of the gussets is provided with a strap having at least one of the fasteners to facilitate forming the container.

12. The case of claim 1, wherein the body further comprises a side strap configured retain the body in the container configuration and to attach a carrying strap to one or more side panels of the plurality of panels.

13. The case of claim 1, wherein the container configuration has a cuboid shape forming a carrying case by folding the panels and the gussets into a container with hingeably connected lid, wherein the cuboid shape remains intact when the front panel, the opposed side panels, and the top inner panel are unfolded from the container configuration to define an opening to the container configuration and a tray hingeably coupled to the container configuration having a base formed from the front panel and three upright walls formed from the opposed side panels and the top inner panel.

14. The case of claim 13, further comprising a releasable lid fastener for latching a lid to the front panel.

15. A foldable carrying case according to claim 12, further comprising:

a carrying strap extending from the side strap.

16. A method for making a foldable carrying case, comprising:

selecting a one-piece outer layer and a one-piece inner layer;

selecting stiffener sheets and closed cell foam sheets;

forming an integrated one-piece body of multiple panels and flexible gussets, each panel being formed by layering the stiffener sheet and the closed cell foam sheet, and covering the sheets with the outer layer on the side of the stiffener sheet and the inner layer on the side of the foam sheets;

connecting the outer layer and inner layer around the sheets to form a single structure of interconnected individual panels, and connecting the outer and inner layers to form gussets in between the panels;

providing the panels and gussets with a plurality of releasable fasteners to removably connect the panels and gussets to form a container, wherein the multiple panels comprises a front panel positioned between and hingeably connected to a pair of opposed side panels, and positioned between and hingeably connected to a bottom panel and a top inner panel, wherein the top inner panel defines a distal edge spaced apart from the front panel;

wherein the plurality of flexible gussets comprises a respective flexible gusset extending between the distal edge of the top inner panel and each of the opposed side panels;

wherein the top inner panel and the flexible gussets extending between the top inner panel and the opposed side panels are configured to retain the top inner panel and the opposed side panels generally perpendicular to the front panel when the front panel is unfolded from the container.

17. A foldable carrying case according to claim 1, wherein the plurality of panels further comprises a bottom panel hingeably connected to the front panel such that the front panel and the bottom panel are generally coplanar when the front panel is unfolded from the container configuration.

18. A foldable carrying case according to claim 17, wherein the gussets are releasably fastenable to the top inner panel such that the two opposed side panels and the top inner panel extend generally perpendicularly from the front panel when the gussets are releasably fastened to the top inner panel.

19. A case according to claim 9, wherein the second fastener component adjoins the top inner panel in sufficient proximity to the flexible gusset adjoining the first fastener component to permit the first fastener component and the second fastener component to matingly engage with each other and to retain the respective side panel and the top inner panel in a generally perpendicular relationship to the front panel when the first fastener component and the second fastener component are matingly engaged with each other.

20. A case according to claim 19, wherein the gusset adjoining the first fastener component comprises a pull tab extending from a portion of the gusset extending between the distal edge of the top inner panel and the side panel, wherein the first fastener component is positioned on the pull tab such that placing the pull tab under tension when the first fastener component and the second fastener component are matingly engaged urges the first fastener component to disengage from the second fastener component.

* * * * *